US010173814B1

(12) United States Patent
Lue et al.

(10) Patent No.: US 10,173,814 B1
(45) Date of Patent: Jan. 8, 2019

(54) BOTTLE WITH STORABLE FLEXIBLE SPOUT

(71) Applicant: Tot Years, LLC, Lansdale, PA (US)

(72) Inventors: Alecia S Lue, Lansdale, PA (US); David D McClanahan, Harleysville, PA (US)

(73) Assignee: Tot Years LLC, Lansdale, PA (US)

( * ) Notice: Subject to any disclaimer, the term of this patent is extended or adjusted under 35 U.S.C. 154(b) by 6 days.

(21) Appl. No.: 15/357,051

(22) Filed: Nov. 21, 2016

Related U.S. Application Data

(63) Continuation-in-part of application No. 14/323,378, filed on Jul. 3, 2014, now Pat. No. 9,499,315.

(51) Int. Cl.

| | |
|---|---|
| ***B65D 47/06*** | (2006.01) |
| ***B65D 23/10*** | (2006.01) |
| ***B65D 41/04*** | (2006.01) |
| ***B65D 1/04*** | (2006.01) |

(52) U.S. Cl.
CPC ..... *B65D 47/066* (2013.01); *B65D 1/04* (2013.01); *B65D 23/102* (2013.01); *B65D 23/108* (2013.01); *B65D 41/04* (2013.01)

(58) Field of Classification Search
CPC ..... B65D 47/066; B65D 1/04; B65D 41/04; B65D 23/108; B65D 23/102
See application file for complete search history.

(56) References Cited

U.S. PATENT DOCUMENTS

| | | | |
|---|---|---|---|
| 4,091,949 | A | 5/1978 | Fowles et al. |
| D263,118 | S | 2/1982 | Wechman |
| D280,599 | S | 9/1985 | Green |
| 4,573,613 | A | 3/1986 | de Freitas |
| D288,526 | S | 3/1987 | Parad |
| 4,732,303 | A | 3/1988 | Wang |
| D301,688 | S | 6/1989 | Green |
| D302,656 | S | 8/1989 | Green |
| 4,852,762 | A | 8/1989 | Chou-Sheng |
| D307,111 | S | 4/1990 | Green |
| D315,867 | S | 4/1991 | Hestehave et al. |
| D323,108 | S | 1/1992 | Green |
| 5,090,601 | A | 2/1992 | Thanisch |
| 5,150,815 | A | 9/1992 | Saklad |
| 5,316,159 | A | 5/1994 | Douglas et al. |
| 5,361,934 | A | 11/1994 | Spence, Jr. |
| 5,497,901 | A | 3/1996 | Chen |
| 5,518,142 | A | 5/1996 | Lin |
| 5,794,819 | A | 8/1998 | Smith |
| D448,971 | S | 10/2001 | Hughes |

(Continued)

*Primary Examiner* — Donnell Long
(74) *Attorney, Agent, or Firm* — Invention To Patent Services; Alex Hobson

(57) ABSTRACT

A bottle has a flexible spout and a cap/cover configuration that effectively seals the spout from leakage and stores it under the cover. The flexible spout is folded or bent in two locations as it is secured within the cover. The flexible spout is folded over from an extended orientation and then around a fold partition. The cover is detachably attached to the cap. A diaphragm extends under the cap and seals liquid within the enclosure. In one embodiment, the cover and cap are configured with a ratchet mechanism that allows the cover to rotate in only one direction. In one embodiment, the bottle comprises two enclosures, and the enclosures may be detachably attached to each other or to a handle.

20 Claims, 16 Drawing Sheets

(56) References Cited

U.S. PATENT DOCUMENTS

| | | | | |
|---|---|---|---|---|
| D509,754 | S | 9/2005 | Scott, III et al. | |
| 7,225,938 | B2 | 6/2007 | Frisch | |
| D562,701 | S | 2/2008 | Thomas et al. | |
| D636,634 | S | 4/2011 | Kemper | |
| 8,336,724 | B2 | 12/2012 | Yamashita et al. | |
| 8,602,238 | B2 | 12/2013 | El-Saden et al. | |
| 8,638,158 | B2 | 1/2014 | Morishita et al. | |
| 8,668,106 | B1 | 3/2014 | Joy et al. | |
| 2005/0061814 | A1 | 3/2005 | Jackel | |
| 2008/0000866 | A1 | 1/2008 | Yates, III | |
| 2009/0065517 | A1 | 3/2009 | Cuocolo | |
| 2009/0255944 | A1 | 10/2009 | Yamashita et al. | |
| 2011/0062117 | A1 | 3/2011 | Kemper et al. | |
| 2011/0062170 | A1* | 3/2011 | Kemper ..... | A47G 19/2266 220/708 |
| 2012/0199546 | A1 | 8/2012 | Dieni | |
| 2013/0277329 | A1* | 10/2013 | DeFelice ..... | B65D 83/0055 215/366 |
| 2014/0001212 | A1 | 1/2014 | Steininger | |
| 2014/0061255 | A1 | 3/2014 | El-Saden et al. | |

* cited by examiner

BOTTLE WITH STORABLE FLEXIBLE SPOUT

CROSS REFERENCE TO RELATED APPLICATIONS

This application is a continuation in part of and claims the benefit of U.S. application Ser. No. 14/323,378, filed on Jul. 3, 2014, entitled Bottle With Storable Flexible Spout and currently pending.

BACKGROUND OF THE INVENTION

Field of the Invention

The present invention relates to bottles and in particular drinking bottles comprising a flexible spout

Background

Drinking bottles with flexible spouts are configured as sports drink bottles as well as drinking bottles for toddlers and young children. The flexible spout reduces the likely hood of spilling the beverage contained within the bottle. A flexible spout may be preferred in many instances as it is easy to ensure positive engagement and again, reduce the likelihood of spills. Many children prefer to drink from flexible spouts as they can exert pressure around the spout and bite down on the spout while drinking. A long extension of the spout from the bottle provides for easier manipulation of the bottle and spout such that the bottle itself does not interfere with the drinker.

Beverage bottles configured with flexible spouts will leak unless there is some closure mechanism. Some beverage bottles comprise a small cap that fits into the top of the spout while others comprise a mechanism to pinch the spout.

Parents and caregivers often offer toddlers and young children different beverage options. Keeping track of various beverage containers throughout the home can become a chore. In addition, packaging and carrying a number of different beverage containers can be burdensome when outside of the home. Care has to be taken to ensure each container is packaged properly so it will not spill and remembering which container has which beverage can become confusing.

SUMMARY OF THE INVENTION

The invention is directed to a bottle having a flexible spout and a cap/cover configuration that effectively seals the spout from leakage. In an exemplary embodiment, the bottle comprises a first enclosure and second enclosure that may be permanently attached by a connection portion or may be detachably attachable to each other or to a handle. An exemplary cap comprises a cap face that is divided into sections, whereby a cover coupled thereto, and covering a portion of the cap, can be rotated from one section to another. An exemplary cap comprises a spout section, a fold section and a cover section. In an exemplary embodiment, the cover rotates from one section to another, or from an open position to a closed position, wherein the flexible spout is stored within the cover. When the cover is in an open configuration, the spout extends from the cap face and is available for a person to drink from the bottle. The cover can then be rotated to push the flexible spout over and subsequently around a fold partition that extends up from the cap face to further fold the flexible spout a second time. This double folding feature further enhances the sealing of the spout, whereby leakage is substantially prevented from the spout when the cover is in a closed position. The extended end of flexible spout is folded about the fold partition and is retained in the fold section of the cap face under the cover when in a closed position.

A spout section comprises a spout aperture wherein the spout extends from the inside surface of the cap to and out from the outside surface of the cap face. A fold section is the portion of the cap that retains the extended end of the spout when the spout is folded about a fold partition. A cover section is the section of the cap face that is exposed when the cover is in a closed position.

The flexible spout is free to extend out from the cap face when the cover is in an open position. An exemplary cover is configured to attach to the cap and cover a portion of the cap face, such as about half of the cap face. In an exemplary embodiment, the cap is circular in shape and the cover is configured to cover about half of the cap face and is semicircular in shape. The cap and cover may be any suitable shape however. The cap face may comprise a cover partition that extends up from the cap face and substantially across said cap face from a first side to a second side. A cover partition may essentially divide the cap face into two substantially equal halves, a first half being the partition section and the second half being divided between the spout section and the fold section. The closure partition may essentially hide and enclose the flexible spout when the cover is in a closed position.

A fold partition is configured between the spout section and fold section of the cap face and extends up to provide a surface for the flexible spout to fold around. A fold partition may extend out radially from a central portion of the cap face and may be planar. A fold partition may be a post, however, or any other extension up from the cap face for folding the flexible spout. In an exemplary embodiment, the cover comprises a pinch feature, such as an extension from a side wall of the cover that is configured to align with the fold partition when the cover is in a closed position. The pinch feature may provide additional pinch pressure on the flexible spout, wherein the flexible spout is pinched between the fold partition and the pinch feature.

A cover may attach to the cap in any suitable way and in an exemplary embodiment, the cover comprises a cover shaft that extends through a cover aperture in the cap. The cover aperture may be centrally located on the cap face and the cover shaft may be a split barbed shaft wherein the barbs engage with the inside surface of the cap to detachably attach the cap to the cover. To detach the cover from the cap in this embodiment, the cap is simply removed from the bottle to expose the inside surface of the cap and the barbs of the cover shaft are pinched to allow the cover shaft to slide out of the cover aperture. Any suitable means to attach the cap to the cover and allow the cover to rotate relative to the cap may be used, however. For example, a cap may comprise a cover post that extends up from cap face and the cover may comprise a recess or aperture to receive the post.

The flexible spout may be coupled with a diaphragm that extends over the opening of the enclosure to seal any liquid therein. The spout and diaphragm may be a unitary piece of material or may be permanently attached or detachably attached. In an exemplary embodiment, the flexible spout is configured to extend down through the diaphragm and into the enclosure. The flexible spout is pliable and able to be bent as much as 90 degrees or more and is resilient, wherein the flexible spout will return to an original orientation when an applied or retaining force is removed. The flexible spout will recover its original extended orientation when it is released from a stored position within the cover, wherein it is folded in two locations.

The cover may be configured to rotate completely around in one direction and a ratcheting feature may be configured between the cap and cover. In an exemplary embodiment, the cover comprises a guide post that is configured to align with a guide recess in the cap. The cap may comprise any number of guide recesses and each may extend any suitable portion around the cap face. In an exemplary embodiment, the guide recess comprises a post stop, or an abrupt change in depth that prevents the cap from rotating in a direction that causes the guide post to impact the post stop. The guide recess may comprise a ramped portion that enable the guide post to rotate up along the ramp, thereby slightly deflecting the cap to allow for rotation in this direction. A guide recess may be very short, thereby providing a resting or stop position for the cover. In an exemplary embodiment, a guide recess and post stop are configured to substantially retain the cover in a closed position, wherein the guide post is within a short length guide recess when the cover is over the fold and spout sections of the cap face. The cover may rotate backwards, or counter to the designed operation direction of rotation, over some angular portion of rotation. For example, the cover may rotate in either rotational directions when the post is not recessed within a guide recess. Any suitable ratcheting feature may be employed to only allow the cover to rotate in one direction about the cap. For example, a series of teeth may be configured around the perimeter of the cap and the cover may comprise one or more pawls that engage with the teeth.

In an exemplary embodiment, the cap, cover and spout are easily detachable from each other to allow cleaning. As described, the cover may be easily attached and detached using a split barbed shaft configuration and the spout and diaphragm may be easily pulled out from the spout aperture of the cap.

The bottle, as described herein, or any of the components, may be configured out of any suitable material, such as plastic, metal, rubber, combinations thereof and the like. In an exemplary embodiment, the single enclosure bottle or dual enclosure bottle are made from plastic and the spout is made of rubber. In another embodiment, the enclosure may be made out of metal and the cap and cover may be made out of plastic. The enclosure may be configured to hold any suitable volume of liquid, such as no more than about 200 ml, no more than about 350 ml, no more than about 500 ml, no more than about 750 ml, no more than about 1 liter and any range between and including the volumes provided.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
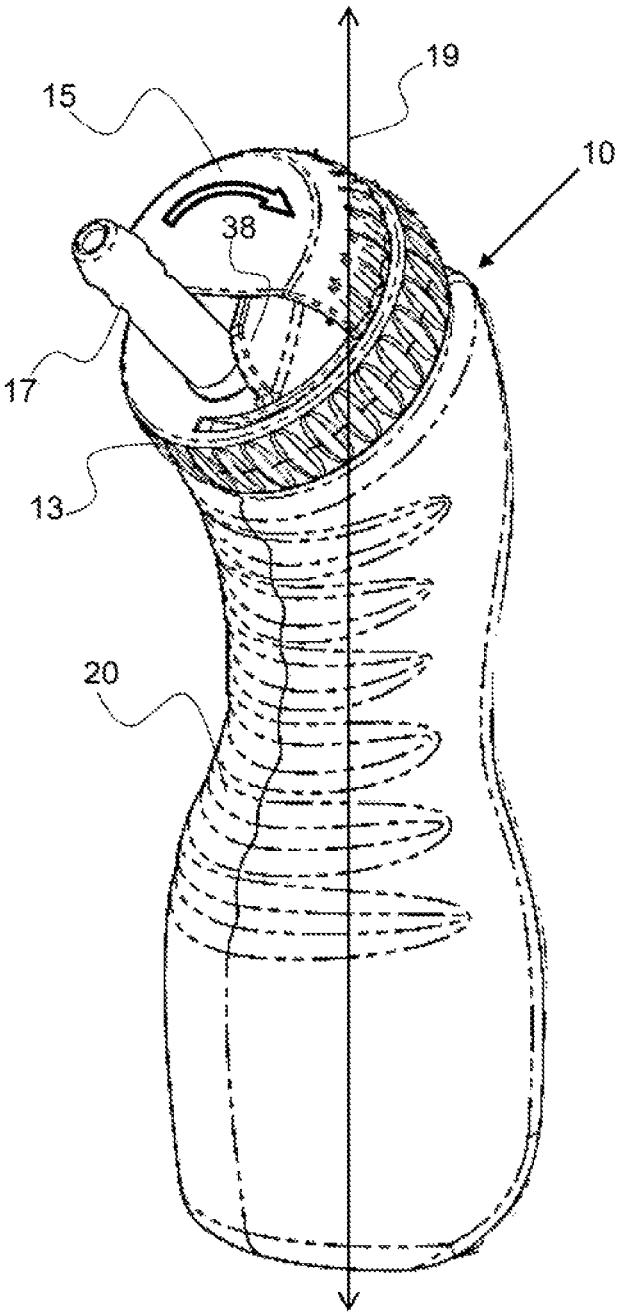

FIG. 1 shows a perspective view of an exemplary bottle having a spout extending from a cap and rotatable cover configured thereon.

Figure 2:
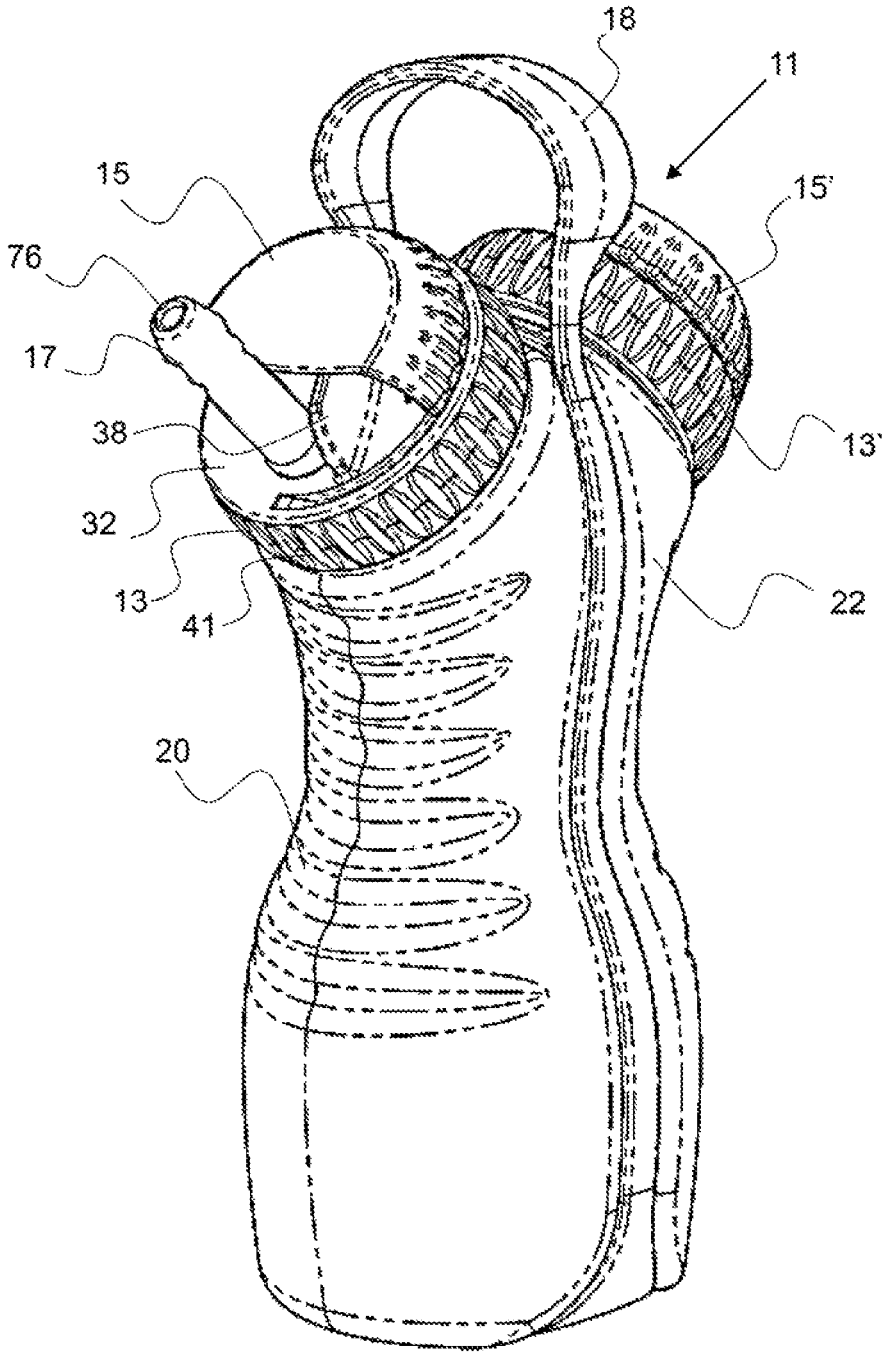

FIG. 2 shows a perspective view of an exemplary bottle having a first and a second enclosure and a handle coupled therebetween.

Figure 3:
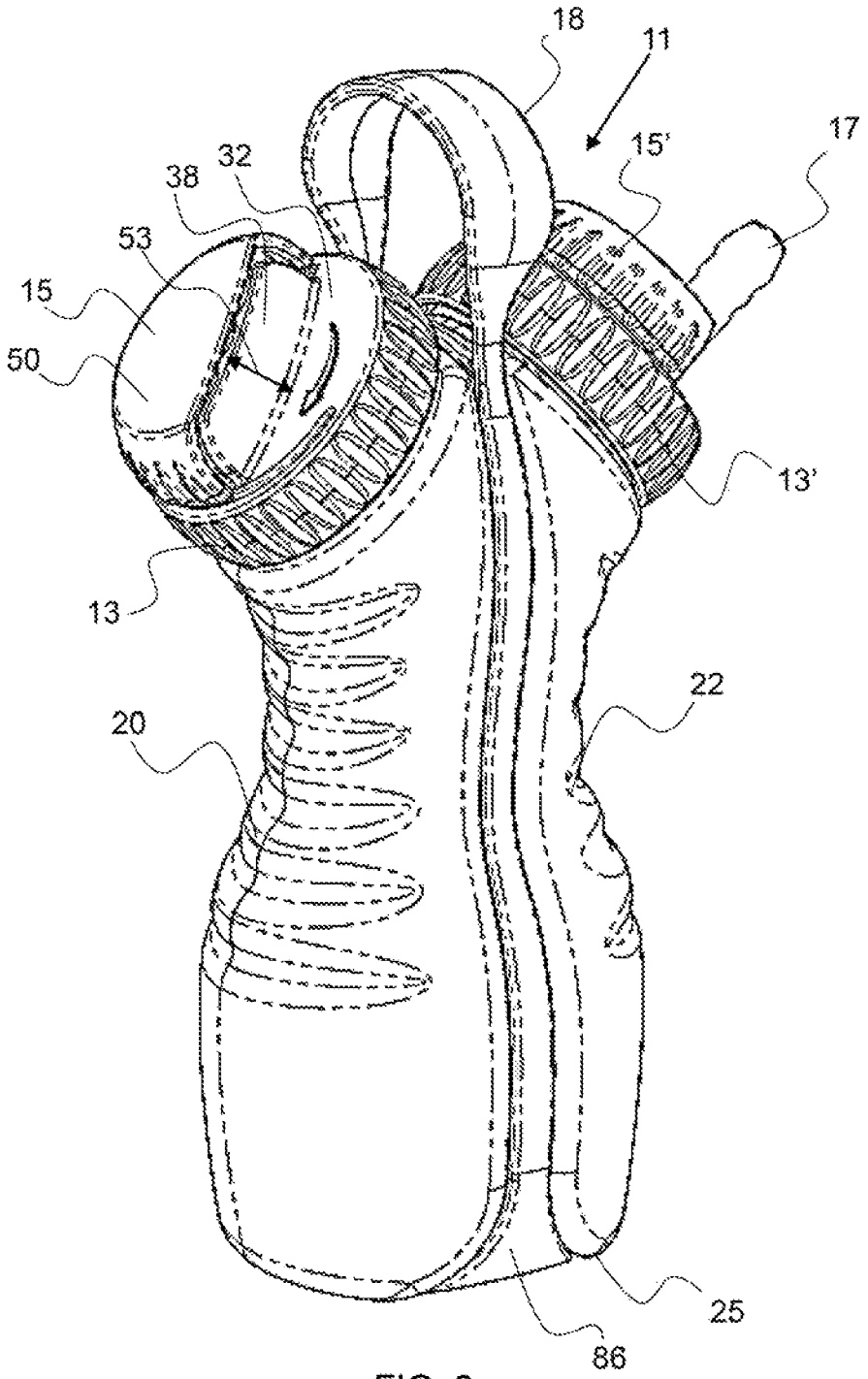

FIG. 3 shows a perspective view of the exemplary bottle shown in FIG. 2 having a first and a second enclosure wherein the first enclosure is configured with the cover in a closed position and the second enclosure is configured with the cover is an open position.

Figure 4:
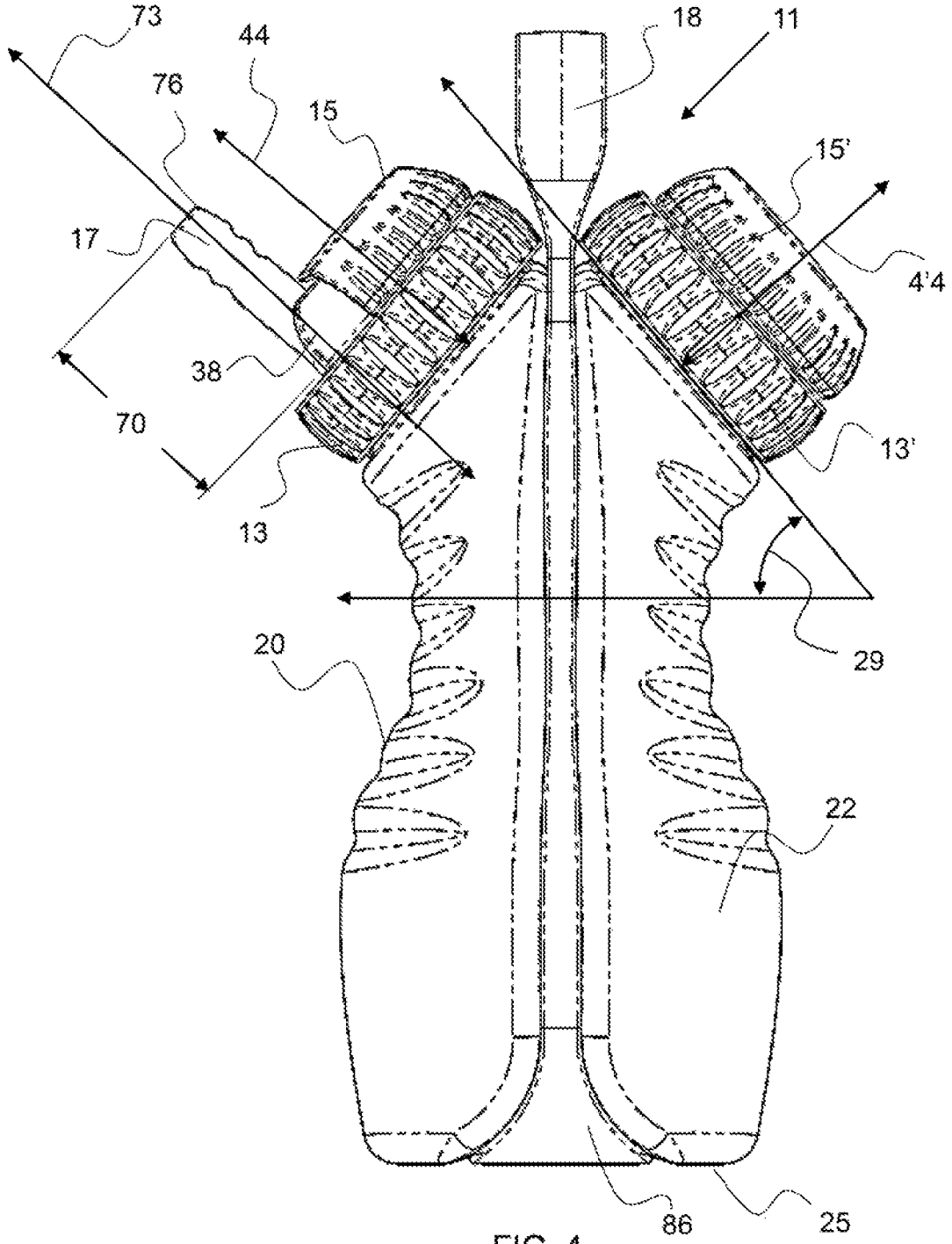

FIG. 4 shows a side view of an exemplary bottle having a first and a second enclosure wherein the first enclosure is configured with the cover in an open position and the second enclosure is configured with the cover in a closed position.

Figure 5:
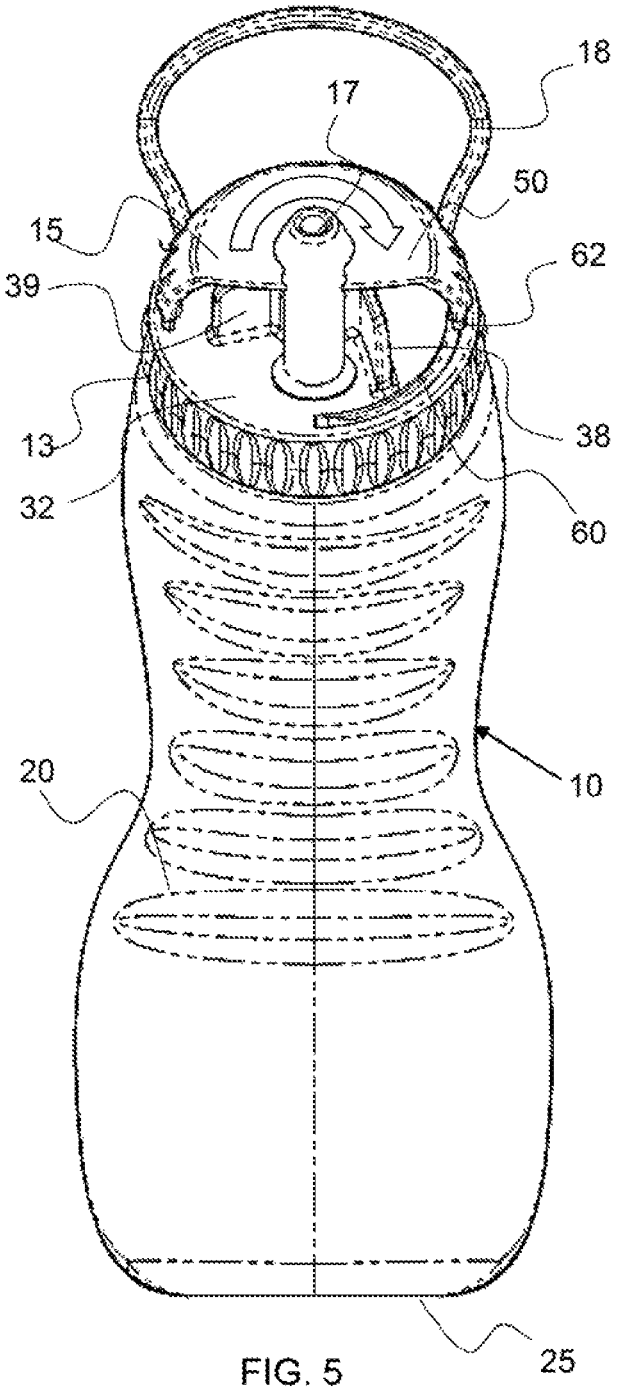

FIG. 5 shows a front view of an exemplary bottle having a closure partition and a folding partition, with the cover in a partially open position.

Figure 6:
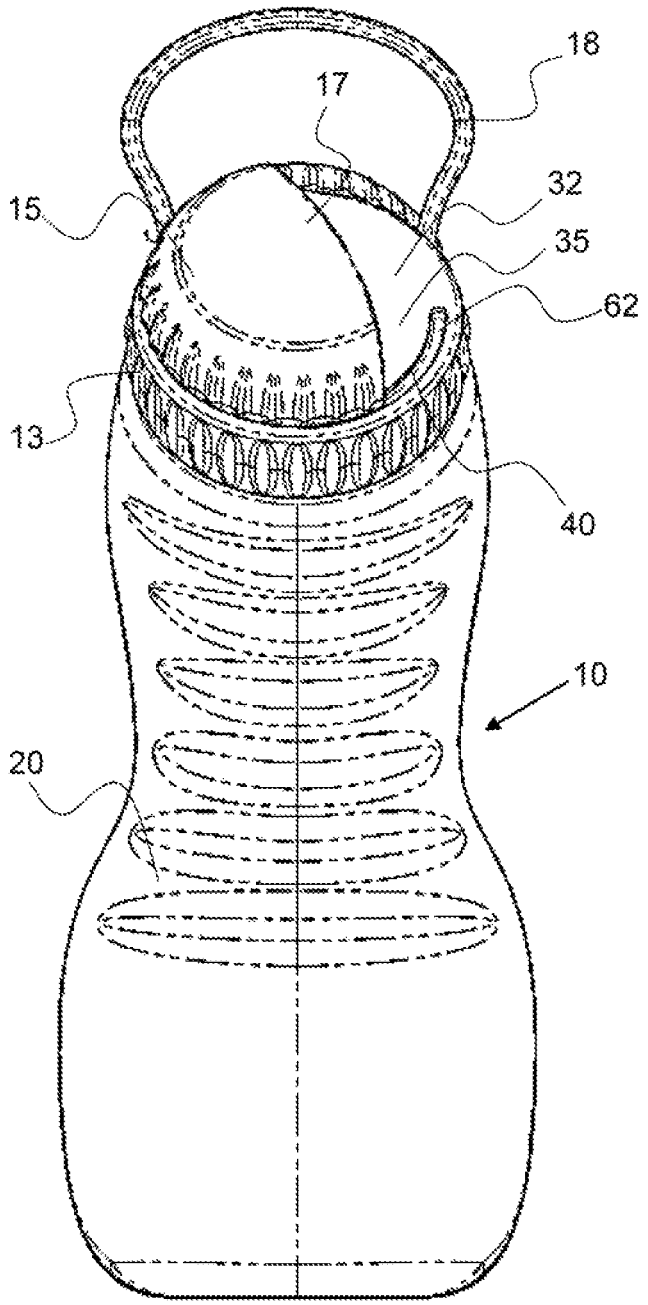

FIG. 6 shows a front view of the exemplary bottle shown in FIG. 5 with the cover in a closed position.

Figure 7A:
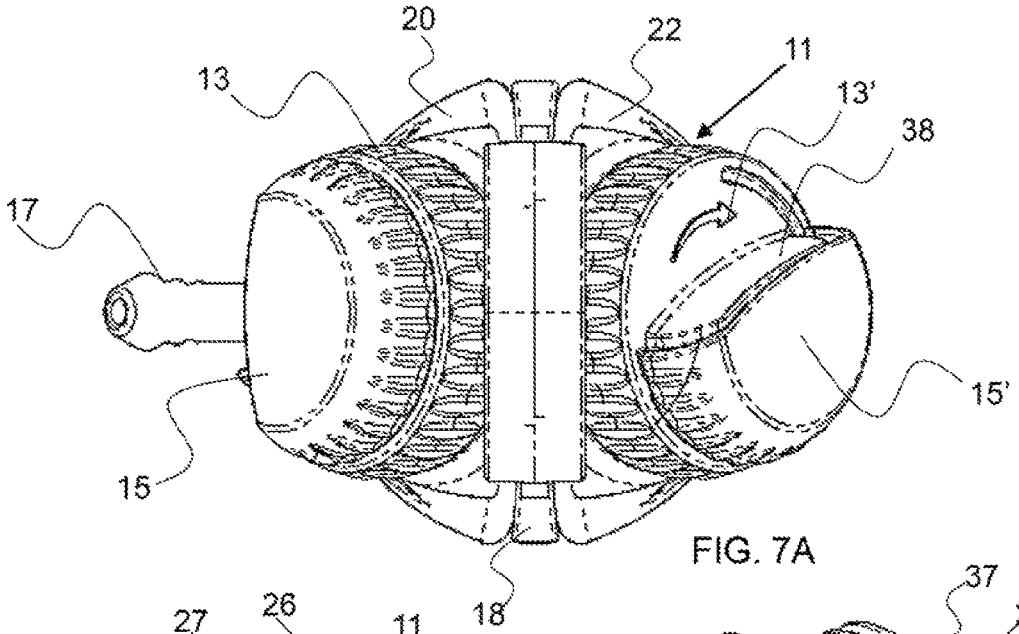

FIG. 7A shows a top-down view of an exemplary dual enclosure bottle with one cover in an open position and a second cover in a closed position.

Figure 7B:
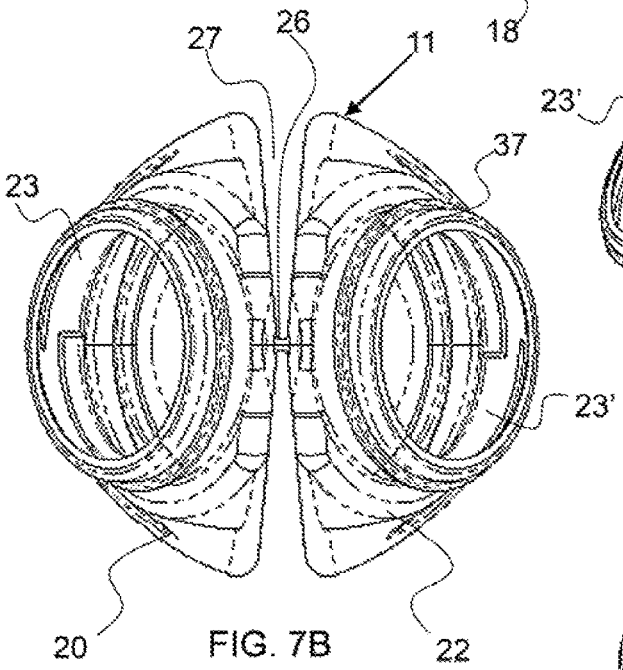

FIG. 7B shows a top-down view of an example dual enclosure bottle with the caps, covers and handle removed.

Figure 7C:
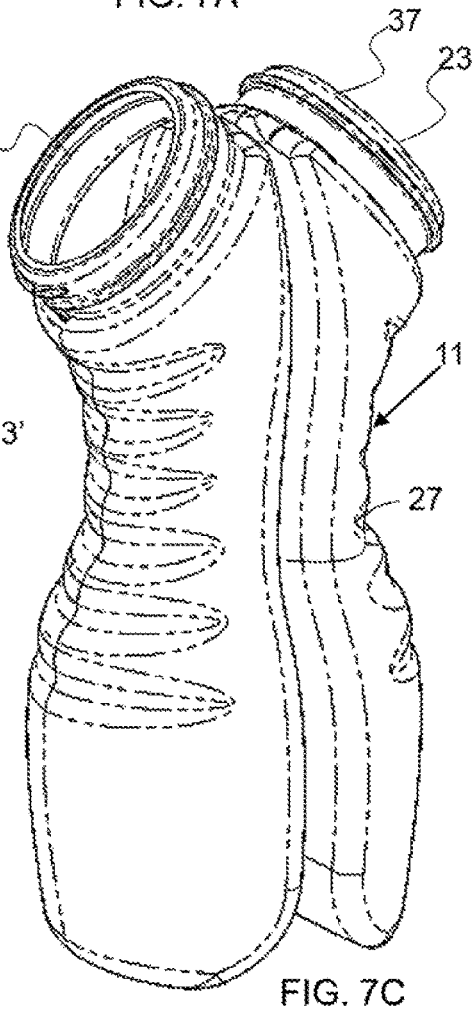

FIG. 7C shows a perspective view of an exemplary dual enclosure bottle with the caps, covers and handle removed.

Figure 8:
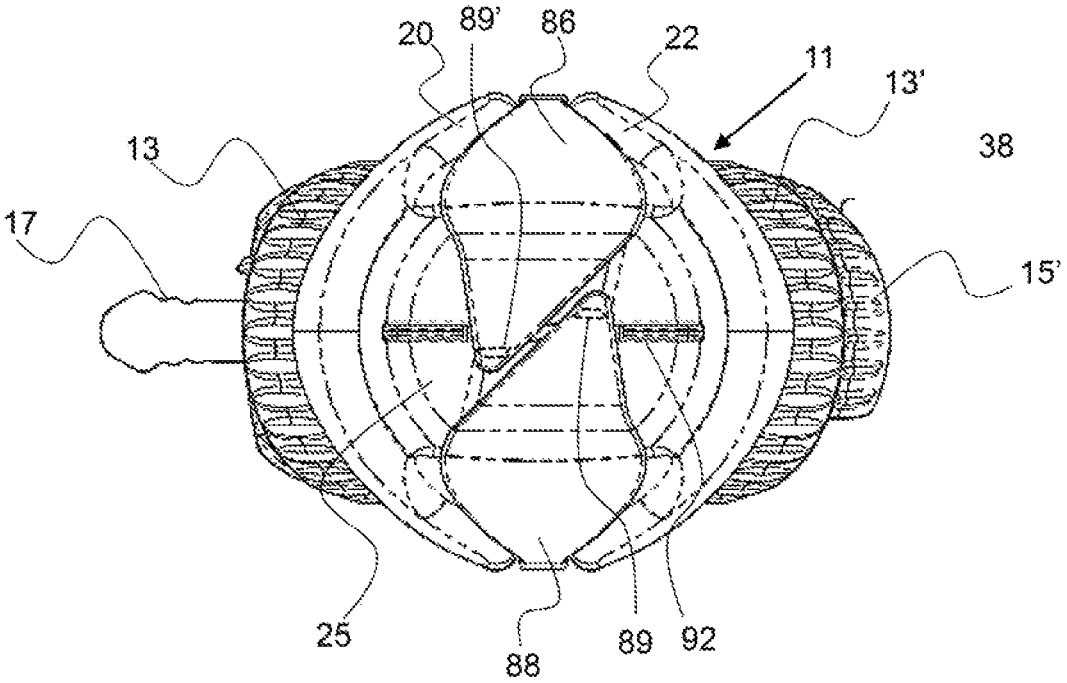

FIG. 8 shows a bottom-up view of an exemplary dual enclosure bottle with the first and second handle extensions connected.

Figure 9A:
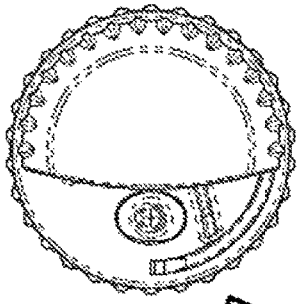

FIGS. 9A to 12B show top-down views of an exemplary cap being moved from an open position, FIG. 9A, to closed position 12A.

Figure 9B:
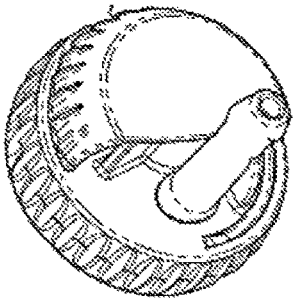
Figure 10A:
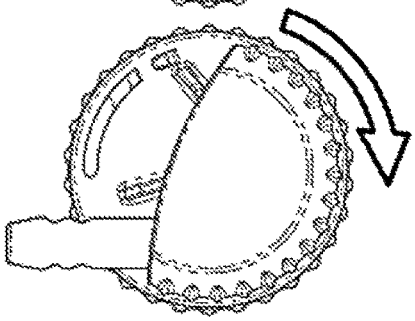
Figure 10B:
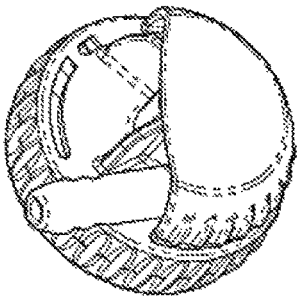
Figure 11A:
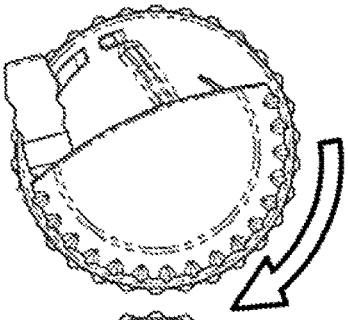
Figure 11B:
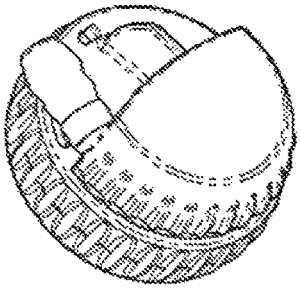
Figure 12A:
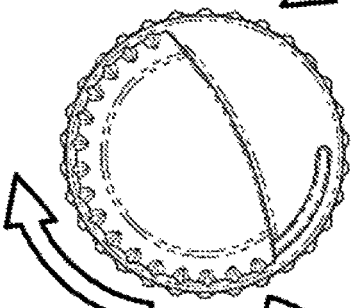
Figure 12B:
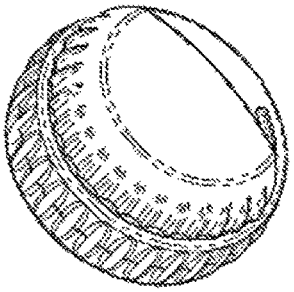

FIGS. 9B to 12B show perspective views of an exemplary cap being moved from an open position, FIG. 9B, to closed position 12B.

Figure 13A:
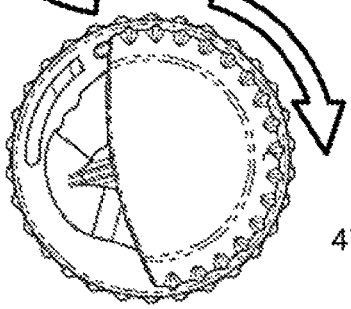

FIG. 13A shows a top-down view of an exemplary cap having the flexible spout being folded around a fold partition.

Figure 13B:
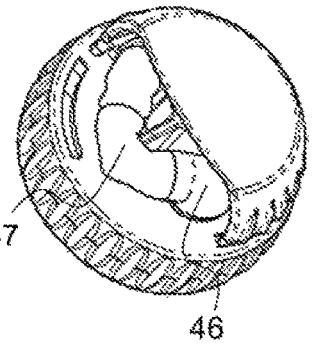

FIG. 13B shows a perspective view of an exemplary cap having the flexible spout being folded around a fold partition.

Figure 14A:
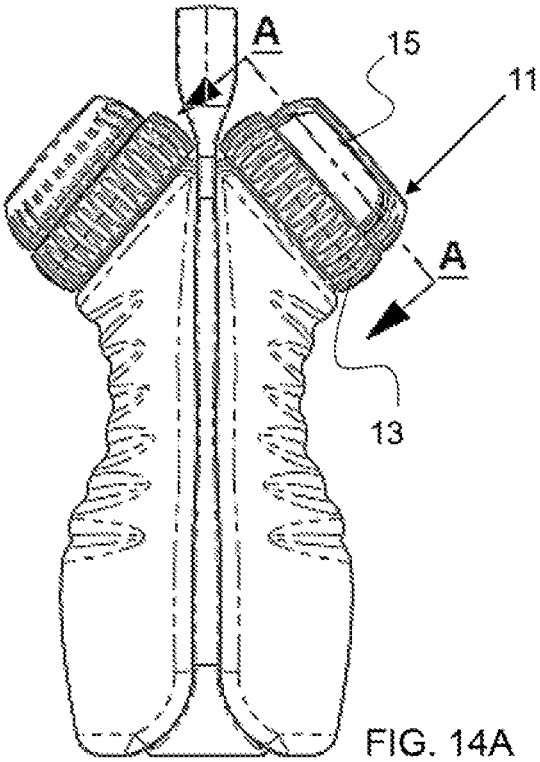

FIG. 14A shows a side view of an exemplary dual enclosure bottle.

Figure 14B:
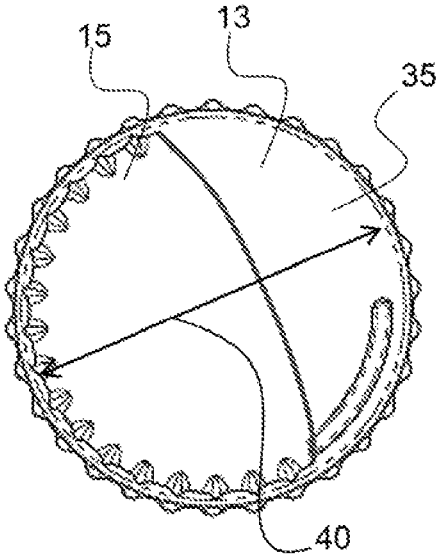

FIG. 14B shows a top-down view of the cap and cover of the dual enclosure bottle shown in FIG. 14A.

Figure 14C:
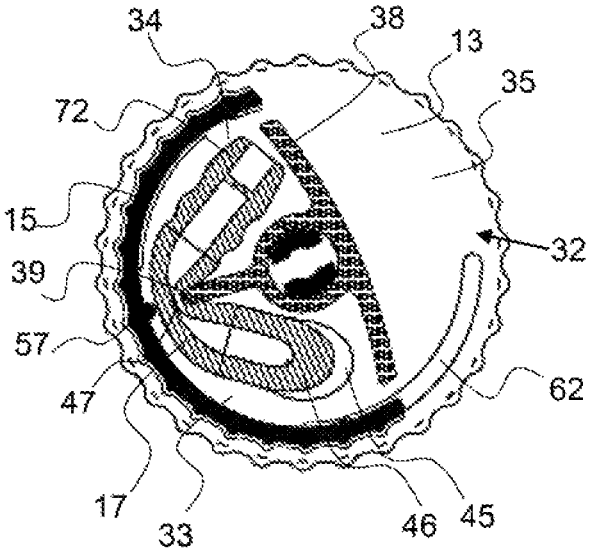

FIG. 14C shows a cut-away view of the cap shown in FIG. 14A along line AA, wherein the flexible spout is folded around the fold partition with the extended end of the spout in the fold section.

Figure 15A:
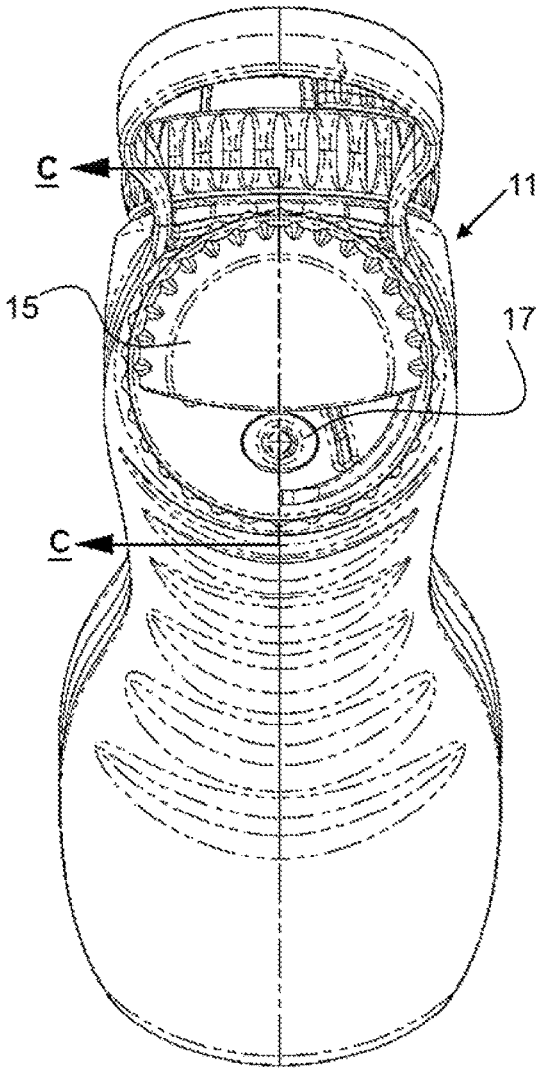

FIG. 15A shows a front perspective view of an exemplary dual enclosure bottle.

Figure 15B:
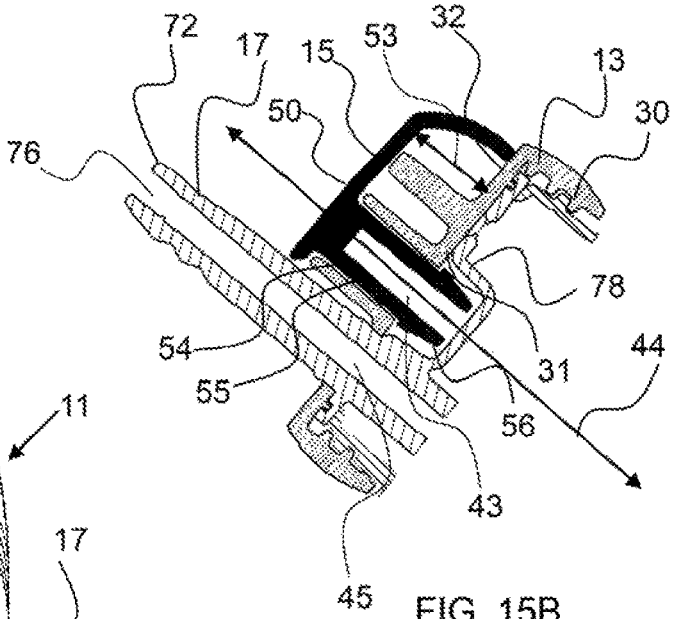

FIG. 15B shows a cut-away view of the dual enclosure bottle shown in FIG. 15A along line CC.

Figure 15C:
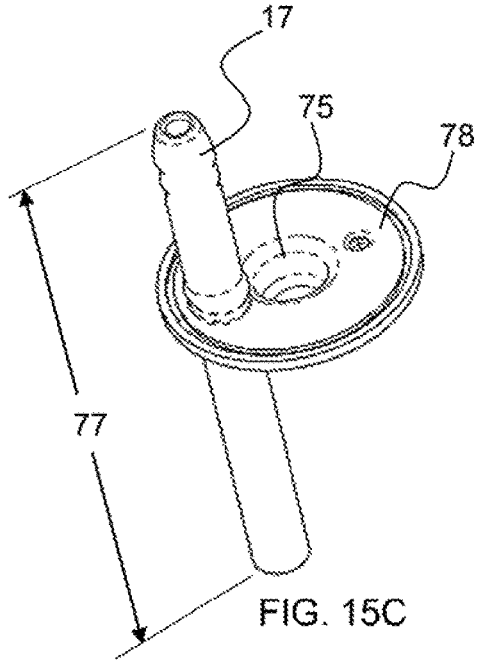

FIG. 15C shows a perspective view of an example flexible spout and diaphragm.

Figure 16:
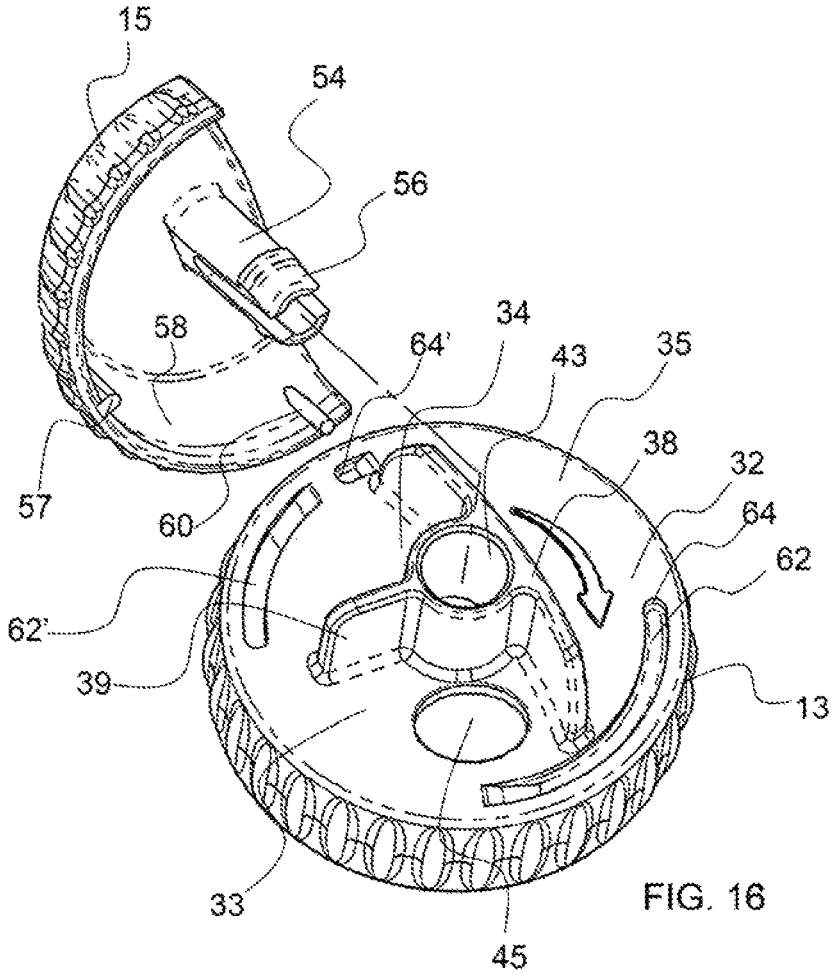

FIG. 16 shows a perspective view of an exemplary cap and cover.

Figure 17A:
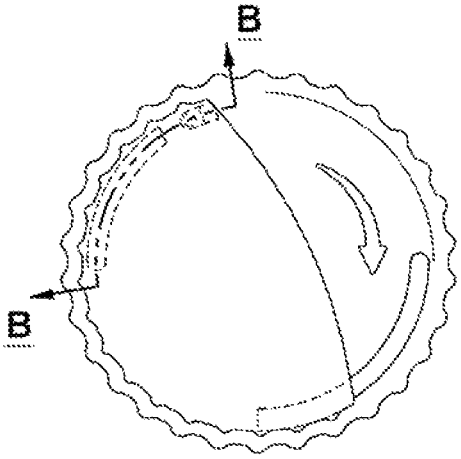

FIG. 17A shows a top-down view of a cap and cover.

Figure 17B:
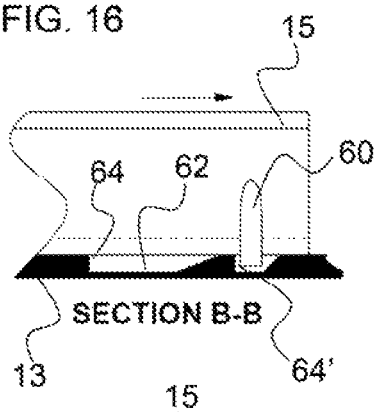

FIG. 17B shows a cut-away view of the cap and cover shown in FIG. 17A along line BB.

Figure 17C:
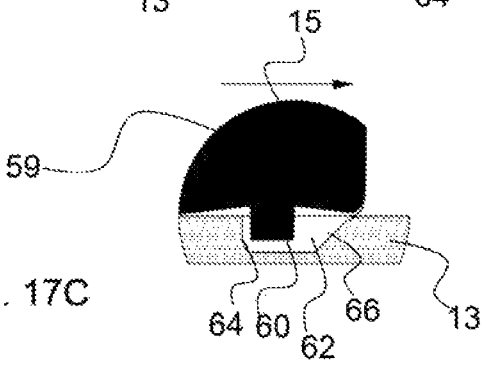

FIG. 17C shows an enlarged view of the post and post stop shown in FIG. 17B.

Figure 18A:
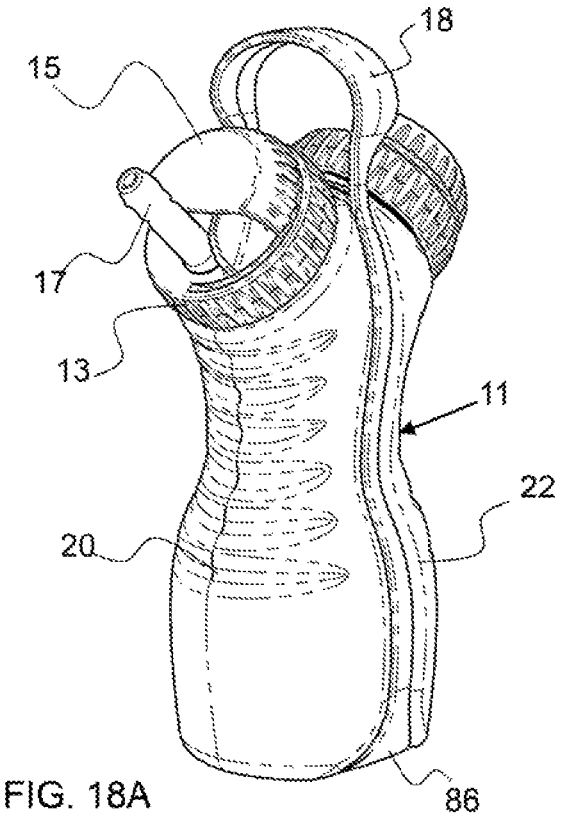

FIG. 18A shows a perspective view of a dual enclosure bottle having a handle being configured between the first and second enclosures.

Figure 18B:
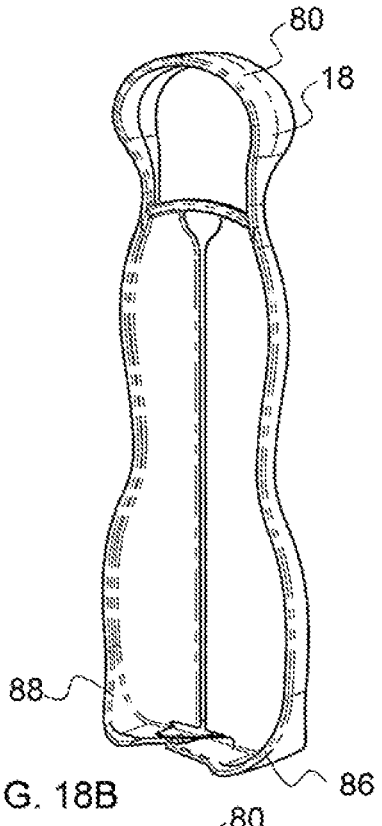

FIG. 18B shows a perspective view of the exemplary handle shown in FIG. 18A having a first and second extension in a closed position.

Figure 18C:
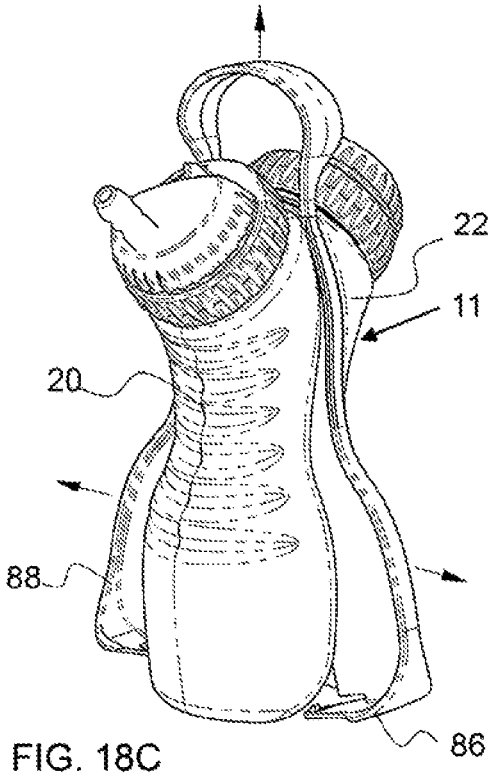

FIG. 18C shows a perspective view of a dual enclosure bottle having a handle being opened with the first and second extensions being spread apart.

Figure 18D:
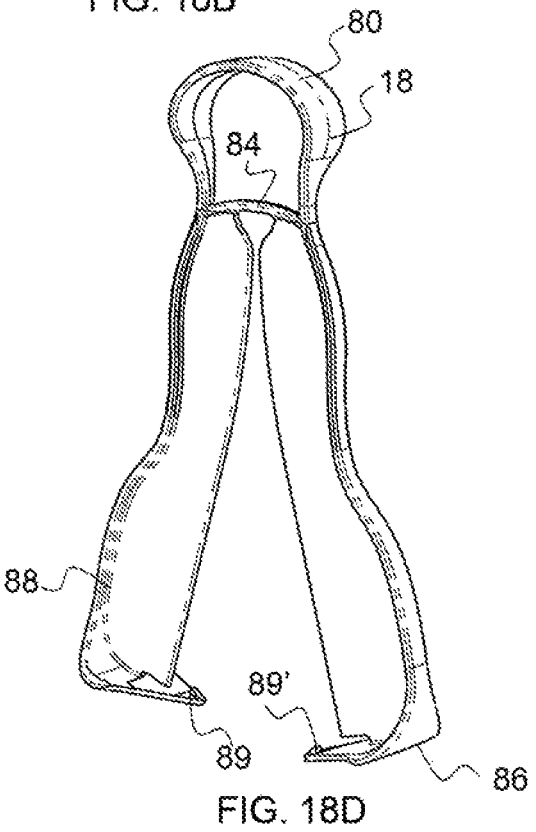

FIG. 18D shows a perspective view of the exemplary handle shown in FIG. 18C with the first and second extension being spread apart.

Figure 19A:
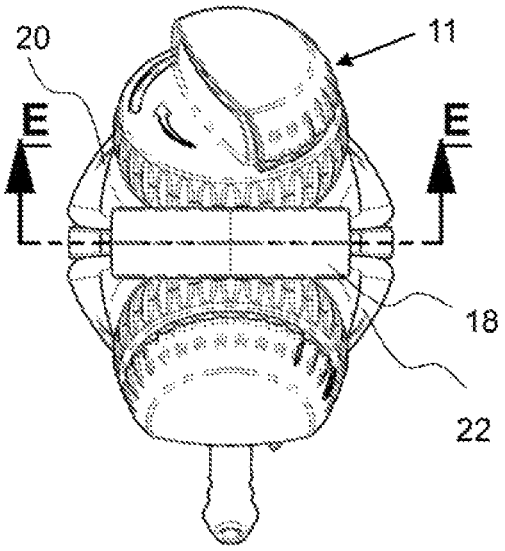

FIG. 19A shows a top down view of a dual enclosure bottle with a handle configured between the two enclosures.

Figure 19B:
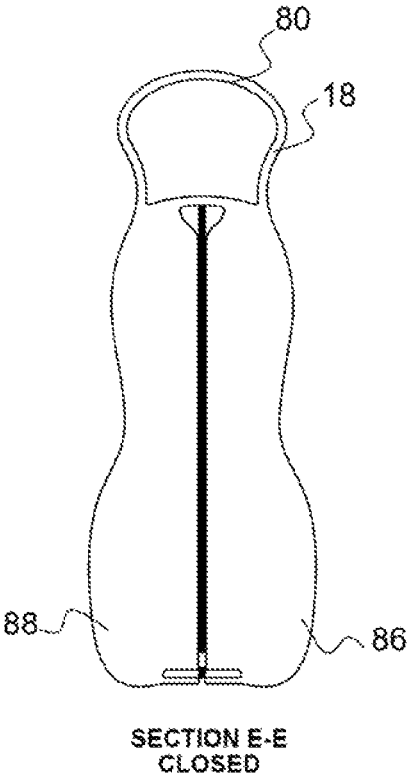

FIG. 19B shows a front view of an exemplary handle having the first and second handle extensions in a closed configuration.

Figure 19C:
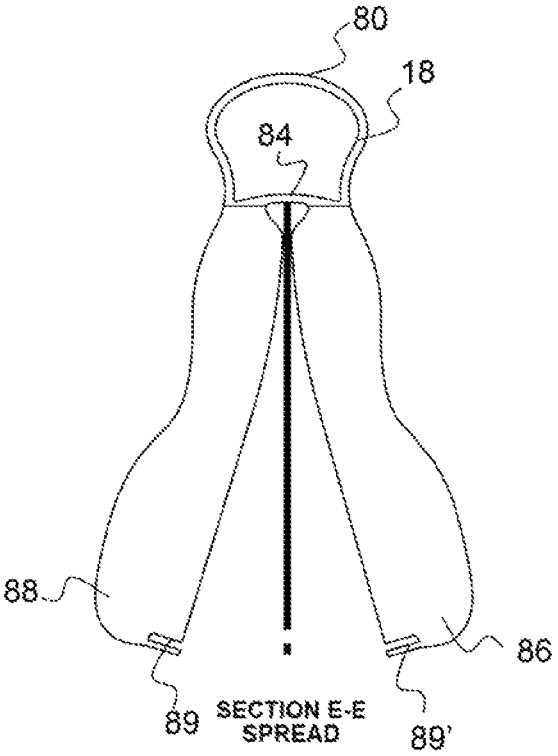

FIG. 19C shows a front view of an exemplary handle having the first and second handle extensions in an open configuration.

Figure 20A:
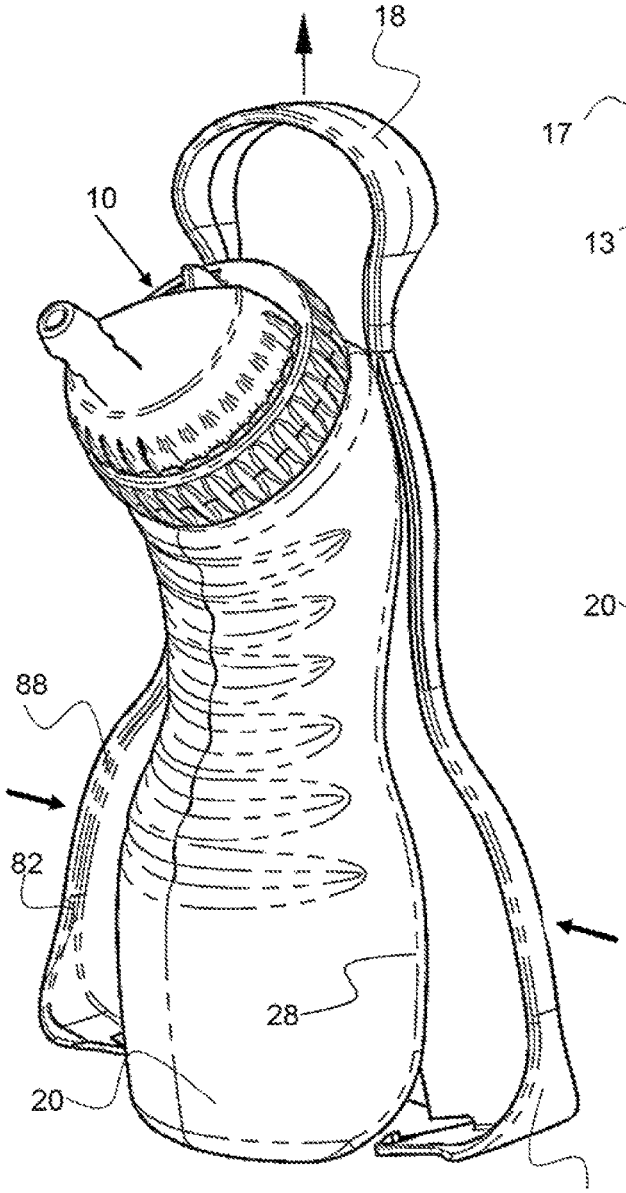
Figure 20B:
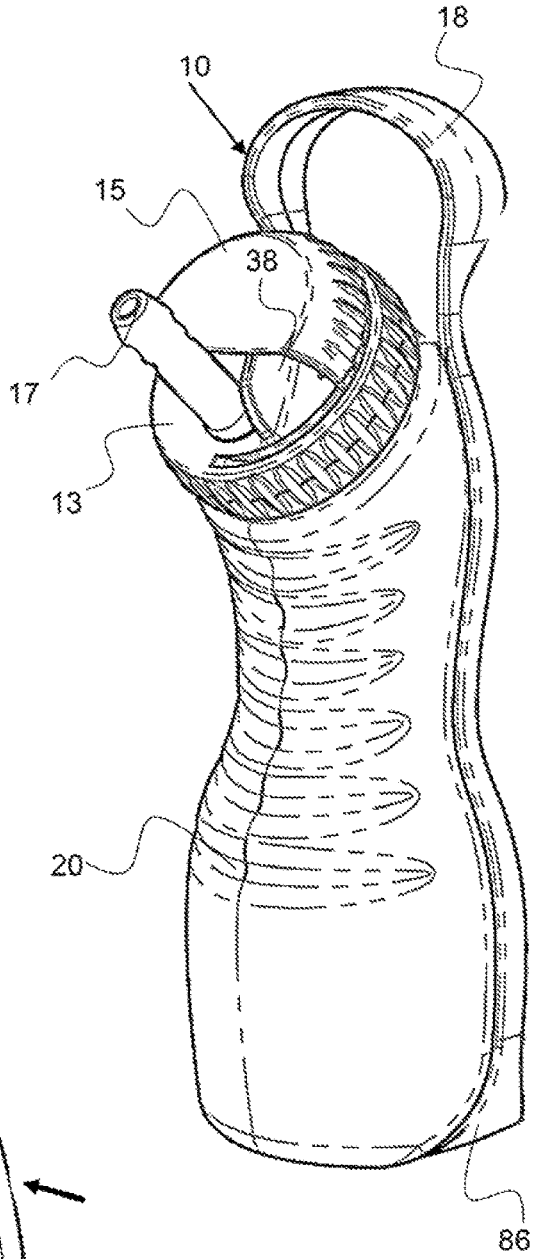

FIG. 20A shows a perspective view of a single enclosure bottle having a handle being closed and attached to the bottle.

FIG. 208 shows a perspective view of the single enclosure bottle shown in FIG. 20A with the handle attached.

Figure 21:
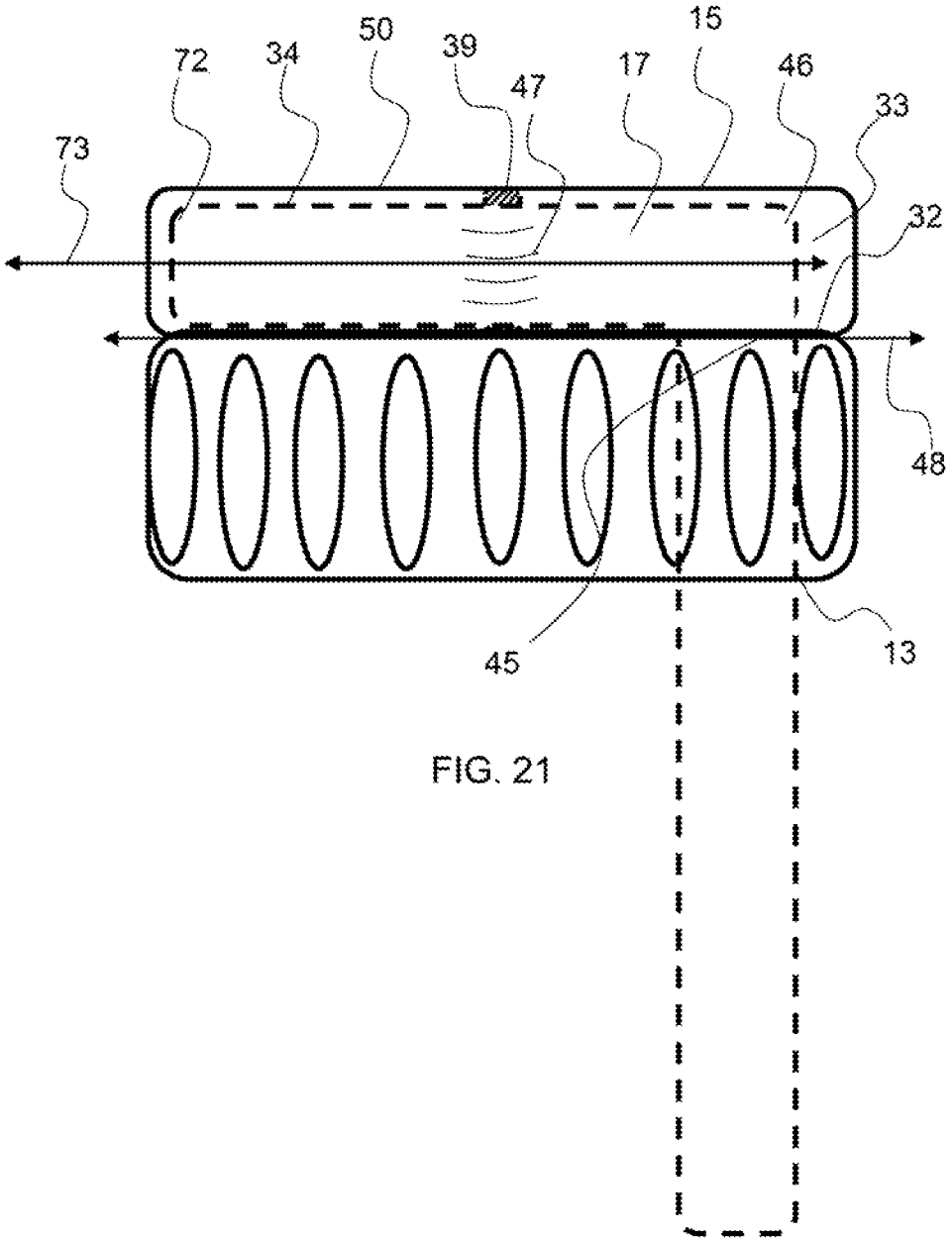

FIG. 21 shows a side view of an exemplary cap, cover and spout with the spout stowed with the cover in a closed configuration.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1 an exemplary bottle 10 has a spout 17 extending from a cap 13 and rotatable cover 15 configured thereon. The bottle 10 comprises a single enclosure 20 and the cap 15 is configured at an off angle from perpendicular to the vertical axis 19 of the bottle. This offset angle enables better positioning of the spout when drinking from the bottle. The cover 15 is configured to rotate in a clockwise direction about the cap, or about a rotational axis, to retain the flexible spout under the cover, as indicated by the arrow.

As shown in FIG. 2, an exemplary dual enclosure bottle 11 has a first enclosure 20 and a second enclosure 22 and a handle 18 coupled therebetween. The first and second enclosures each have a cap 13, 13' and cover 15, 15' respectively, as described herein. The spout 17 is extending from the cap face 32 of the first enclosure 20. The closure partition 38 is shown extending up from the cap face. The outer perimeter 41 of the cap is shown and the cap has a circular outer perimeter.

As shown in FIG. 3, the exemplary dual enclosure bottle 11 has the first enclosure 20 configured with the cover 15 in a closed position and the second enclosure 22 configured with the cover 15' is an open position. The covers have been rotated on each of the enclosures to switch which enclosure a person may drink from. The closure partition 38 is shown hiding, or enclosing the flexible spout under the cover 15. Also shown in FIG. 3 is a handle 18 that extends up between the two enclosures. The handle has a first extension 86 and second extension (not shown) that are configured between and extend under the two enclosures. The two handle extensions attach at the bottom 25 of the bottle. The top portion 50 of the cover 15 is at an offset distance 53 from the cap face 32 which provides space for storing the spout under the top portion of the cover.

As shown in FIG. 4, an exemplary dual enclosure bottle 11 has a first enclosure 20 and a second enclosure 22. The first enclosure 20 is configured with the cover 15 in an open position and the second enclosure 22 is configured with the cover 15' in a closed position. The caps are configured at an offset angle 29 from perpendicular to the vertical plane. The offset angle may be any suitable angle such as greater than about 10 degrees, greater than about 25 degrees, greater than about 40 degrees, greater than about 60 degrees and any range between and including the offset angles provided. As described, this offset angle enables better manipulation of the flexible spout when holding the bottle. The exposed length 70 of the flexible spout, from the cap face to the extended end, is shown. The length axis 73, or the axis extending along the length of the flexible spout from the cap face to the extended end, is also shown. The length axis of the flexible spout is substantially perpendicular to the cap face when the spout is in an extended and ready position. The exposed length of the spout may be any suitable length and may be greater than the diameter of the cap face or a cross dimension across the cap face from one side to an opposing side, for example. The two fold, an aperture fold and a partition fold, configuration of the flexible spout in a stowed position enables a long flexible spout to be retained within the area of the cap face. The covers rotate clockwise or counter-clockwise about a rotational axis 44. The rotational axis may be substantially perpendicular to the cap face.

As shown in FIG. 5, an exemplary bottle 10 has a closure partition 38 and a folding partition 39 extending up from the cap face 32. The cover 15 is in a partially open position and the arrow indicates the direction of rotation of the cover. The top portion 50 of the cover will intersect and engage with the flexible spout 17 as the cover is rotated to fold or bend the flexible spout over.

As shown in FIG. 6, the exemplary bottle 10 shown in FIG. 5 has the cover 15 in a closed position. The cover has been rotated such that the cover is positioned over the spout section and fold section. The cover section 35 of the cap face 32 is exposed when the cover is in a closed position, as shown. A guide recess 62 is also shown extending around a portion of the perimeter of the cap face.

As shown in FIG. 7A, an exemplary dual enclosure bottle 11 has one cover 15 in an open position and a second cover 15' in a closed position. The handle 18 extends up from between the two enclosures.

As shown in FIG. 7B, an example dual enclosure bottle 11 has a first enclosure 20 and second enclosure 22 with openings therein 23 and 23' respectively. The caps have been removed as well as the handle. The openings comprise threads 37 around the outside of the opening for detachably attaching a cap. The two enclosures are integrally connected by a connector portion 26, such as a piece of plastic that bridges between the two enclosures. The two enclosures are a one-piece unit in this embodiment, with the two enclosures being integrally connected by the connector portion. The two enclosures may be made by blow molding and the connector portion may be a piece of plastic material that is unitary with both enclosures. It is to be understood that the two enclosures may be configured to be detachably attached to each other. Any suitable detachable attachment geometry may be employed to couple a first enclosure with a second enclosure. Also show in FIG. 7B is a handle recess extending between the two enclosures, wherein the handle extensions may be configured around the dual enclosure bottle.

As shown in FIG. 7C, an exemplary dual enclosure bottle 11 has the caps, covers and handle removed. The male threads 37 around the openings 23 are clearly shown and a cap having female threads may be detachably attached to the enclosure by simply screwing the cap onto the threads around the opening.

As shown in FIG. 8, an exemplary dual enclosure bottle 11 has the first handle extension 86 and second handle extension 88 connected with a handle extension attachment feature 92 at the base or bottom 25 of the bottle. The extension/bottle attachment feature 92 is a geometric portion of the bottle that is configured to connect and retain the handle extension. The extension attachment features 89, 89' are shown in dashed lines as they are configured to couple with the extension/bottle attachment feature along the base of the bottle.

As shown in FIG. 9A to 12B, an exemplary cap is being moved from an open position, FIG. 9A, to closed position 12A. In FIG. 9A, the cap is in an open position and is configured such that the flexible spout is extending from the spout section. In FIG. 10A the cap has been rotated clockwise, as indicated by the arrow, to cause the cap to hit and engage the flexible spout and push and fold it over, whereby the spout is essentially parallel with the cap face, or substantially perpendicular to the length axis of the spout when the spout is in an extended configuration, as shown in FIG. 4. In FIG. 11A, the cap has been rotated further, and has folded the flexible spout about a folding partition. In FIG. 12A the cap is in a closed position and is configured over both the spout and fold sections of the cap face.

As shown in FIG. 9B to 12B, an exemplary cap is being moved from an open position, FIG. 9B, to a closed position 12B. In FIG. 10B, the flexible spout is folded from an upright position, or extended position, to be substantially parallel with the cap face. The length axis of the flexible spout, or the axis extending along the length of the flexible spout from the cap face to the extended end, which in FIG. 9B is substantially perpendicular with the cap face, is substantially aligned with the cap face in FIG. 10B. In FIG. 10B the fold partition is shown extending radially out from a central location on the cap face. In FIG. 11B, the flexible spout has been folded partially around the fold partition. In FIG. 128, the cap is in a closed position and is configured over the spout section and fold section.

As shown in FIGS. 13A and 13B, an exemplary cap has the flexible spout folded at an aperture fold 46 and at a partition fold 47, wherein the spout is folded around the fold partition. The aperture fold is substantially a 90 degree fold and the partition fold is folded about the fold partition to retain the spout along the inside perimeter wall of the cover. The cap is being turned to an open position, wherein the extended end of the flexible spout will be released by the cap from the fold section and the flexible spout will pop back up into a ready position. The cover may be rotated back, or counter clockwise, to fully allow the flexible spout to extend unencumbered by the cover. The length axis of the flexible spout is substantially parallel with the cap face when in a stored position.

As shown in FIG. 14A, an exemplary dual enclosure bottle 11 has both the caps in a closed position. As shown in FIG. 14B, the cap and cover of the dual enclosure bottle shown in FIG. 14A are in a closed position. The cap face diameter 40 is shown in FIG. 14B. As shown in the cut-away view of FIG. 14C, the flexible spout 17 is folded around at an aperture fold 45, where the spout extends out from the spout aperture, and about the fold partition 39 with the extended end 72 of the spout in the fold section 34. A pinch feature 57 of the cover 15 further ensures that the spout will not leak in the partition fold 47. The spout has two folds; a first fold where the spout is coupled with the cap through the spout aperture 45 in the cap 13 and a second around the fold partition. The spout is retained between the spout section 33 and the fold section 35. A pinch feature 57, extends from the inside surface of the cover 15, or interior sidewall, and is aligned with the fold partition to increase the pinching force on the flexible spout. The closure partition 38 extends substantially from across the cap face 32 and substantially divides the cap face into two sections; the cover section, and the spout and fold section.

As shown in FIG. 15A, an exemplary dual enclosure bottle 11 is in an open configuration with the flexible spout 17 extending out from the cap face. As shown in the cut-away view of FIG. 15B, spout 17 is coupled with the diaphragm 78 configured under the cap. The diaphragm extends over the opening in the enclosure and around the perimeter 30 of the cap to seal in liquid. The flexible spout extends through the diaphragm and down into the enclosure. The spout orifice 76, extending down through the flexible spout, allows a person to draw a fluid up from the enclosure through the flexible spout. The flexible spout extends through the spout aperture 45 in the cap 13. The cover 15 is attached to the cap 13 by the cover shaft 54 that extends through the cover aperture 43 in the cap. The cover shaft is a split barbed shaft 55 having a plurality of barbs 56. The barbs extend out along the inside surface 31 of the cap and retain the cover to the cap. A person may detach the cover from the cap by first removing the cap and then pinching the barbs to release the cover shaft through the cover aperture. The cover offset distance 53 is shown between the cap face and the top portion 50 of the cover 15.

As shown in FIG. 15C, an example flexible spout 17 is coupled with an exemplary diaphragm 78. The diaphragm has a cover shaft recess 75 configured therein to enable the cover shaft to extend down into the cover aperture. The overall length 77 of the flexible spout is shown in FIG. 15C. The flexible spout may be configured to fit down to substantially the bottom of the enclosure.

As shown in FIG. 16, an exemplary cap 13 and cover 15 are detached from each other. The exemplary cap 13 comprises a cap face 32 comprising a cover section 35, a spout section 33 and a fold section 34. The closure partition 38 extends up from the cap face and substantially equally divides the cap face. A fold partition extends radially out from the center of the cap leaving a space for the flexible spout to fold there around. The spout section comprises a spout aperture 45. The cap further comprises a cover aperture 43, wherein the cover shaft 54 is configured to extend therethrough. The pinch feature 57 of the cover is shown extending from the inside perimeter wall 58. A guide post 60 on the cover 15 is configured to extend down into the guide recess 62, 62' and post stop 64' configured in the cap 13.

As shown in FIG. 17A, a top-down view of a cap and cover indicated a cut away section along line BB. As shown in the cut-away view along line BB of FIG. 17B, the cover post 60 is configured in the post stop 64'. The post stop is an abrupt depth change or lead-in-wall to a guide recess. This wall ensures that the cover cannot be turned in a counter direction to the designed direction, as the post would hit against this wall and prevent the cover from rotating. The guide recess 62 shown in FIG. 17B also has a post stop 64 and has a tapered portion or ramp that will allow the post to exit the guide recess by a slight flexure of the cover upward.

As shown in FIG. 17C, the post 60 is configured in the guide recess 62 that is very short in length and substantially holds the post and cover attached thereto in a substantially fixed position. This type of guide recess may be referred to as a stop, wherein upon rotation of the cover to this location, the post will drop into the stop and have resistance from moving further in the rotation direction. In addition, counter rotation of the cover will be prevented by the post stop 64. When a user wants to further rotate the cover, such as from a closed position to an open position, a force will be required to move the post 60 up and across the ramp portion 66 of the guide recess 62.

As shown in FIG. 18A, a dual enclosure bottle 11 has a handle 18 that is configured between the first and second enclosures 20, 22 respectively.

As shown in FIG. 18B, the exemplary handle shown in FIG. 18A has a first and second extension 86 and 88 respectively, in a closed position.

As shown in FIG. 18C, a dual enclosure bottle 11 has a handle 18 that is being opened with the first and second extensions 86, 88 being spread apart, as indicated by the arrows pointing away from the bottle. A person may pull the handle extension apart and lift the hand up and off.

As shown in FIG. 18D, the exemplary handle 18 shown in FIG. 18C has first and second extension 86, 88, that are spread apart from a pivot portion 84 of the handle. The handle also has a grip portion 80 having an aperture therethrough to allow easy handling of the handle. The handle extensions comprise extension attachment features 89, 89' that are configured to detachably couple with a extension/bottle attachment feature 92 (not shown). In another embodiment, the first handle extension 86 is configured to couple with the second extension 88, wherein attachment features 89, 89' are configured to couple with each other under the bottom of the bottle.

As shown in FIG. 19A, a dual enclosure bottle 11 has a handle 18 configured between the two enclosures 20 and 22.

As shown in FIG. 19B, an exemplary handle 18 has the first and second handle extensions 20, 22 respectively, in a closed configuration.

As shown in FIG. 19C, an exemplary handle 18 has the first and second handle extensions 86, 88 is an open configuration.

As shown in FIG. 20A, a single enclosure bottle 10 has a handle 18 being closed and attached to the bottle. A bottle attachment feature 82, configured on the handle, is coupled with a handle retainer feature 28 to detachably attach the handle to the bottle. The bottle attachment feature may be a geometric configuration, such as a protrusion or recess configured to align with a handle retainer feature, such as a protrusion or recess, on the enclosure to prevent the bottle form being pulled out from the handle when the handle extensions are coupled together in a closed position.

As shown in FIG. 208, the single enclosure bottle 10 shown in FIG. 20A has the handle 18 attached.

As shown in FIG. 21, the spout 17 is folded down and stowed under the top surface 50 of the cover 15 and extends from the spout section 33 to the fold section 34. The spout is folded in two locations, at the spout aperture 45 where there is an aperture fold 46 in the spout and at the fold partition where there is a partition fold in the spout. The two folds effectively seal the spout to prevent leakage of liquid inside the enclosure through the spout. The spout is folded in a stowed configuration, with the cover in a closed configuration, and has a length axis 73 that is substantially parallel with the cap face 32 or cap face plane 48. The cap face plane is a plane extending parallel with the cap face. The spout extending substantially parallel with the cap face and along the inner perimeter of the cover enables a longer exposed length of spout to be stowed with this unique cover and cap configuration. Substantially parallel, as used herein to describe the orientation of the spout with respect to the cap face or cap face plane shall include offset angles between the exposed spout length and the cap face of no more than about 25 degrees, or no more than about 15 degrees. A longer spout is very desirable for smaller children to facilitate drinking from the bottle.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A bottle comprising:

a) at least one enclosure having an opening;

b) a detachably attachable cap configured to be attached to said bottle over said opening comprising;

i) an inside surface;

ii) an outside surface;

iii) a perimeter;

iv) a cap face comprising:

a spout section;

a fold section; and a cover section;

v) a spout aperture located in the spout section that extends from an outside surface to the inside surface wherein said spout aperture is offset from a center of the cap face vi) a closure partition that extends up from said cap face and across said cap face from a first side to a second side and between said cover section, and said spout and said fold sections of the cap;

vii) a fold partition that extends up from said cap face and is configured between the spout section and fold section;

c) a cover configured to cover a portion of said cap and configured to rotate, clockwise or counter clockwise about a rotational axis, from a closed position to an open position and comprising:

a top portion that is offset from the cap face by a cover offset distance;

an inside perimeter wall that extends circumferentially around said top portion of the cover;

d) a flexible spout coupled to said cap in said spout section and having an extended end, an exposed length from the spout aperture to the extended end, an overall length and length axis;

wherein said cover is configured to rotate from an open position, wherein the spout section is not covered, to a closed position, wherein said top portion of the cover is configured over the spout section;

whereby when said cover rotates from an open position to a closed position, the top portion of the cover intersects with said spout and folds said spout, at the spout aperture, to align said exposed length of the flexible spout to be parallel with and tangential to the outside surface of the cap face and wherein the extended end of the spout extends beyond an outer perimeter of the cap, wherein the spout is folded from a substantially perpendicular orientation to the cap face to a substantially parallel orientation to the cap face, and whereby further rotation of said cover creates a second fold in the spout that is located along an exposed length of the spout and about said fold partition, wherein in the closed position, the spout is retained under the top portion of the cover with the extended end of said spout in the fold section of said cap and wherein the spout extends from the spout aperture along the cap face and through a space between the fold partition and the inside perimeter wall of the cover such that a fold of the flexible spout about the fold partition is in a radial direction to a direction of rotation of the cover;

wherein in the closed position, the spout is folded in two separate locations, at the spout aperture and around the fold partition and wherein the spout is retained in a retained configuration under the cover with the length axis substantially parallel with the cap face and wherein the exposed length of the spout is aligned with the cap face.

2. The bottle of claim 1, comprising a first enclosure and a second enclosure; each of said enclosures comprising said detachably attachable cap, cover and spout as described in claim 1 whereby the first enclosure is attached to said second enclosure.

3. The bottle of claim 2, where the first enclosure and second enclosure are detachably attachable to each other.

4. The bottle of claim 1, wherein the cap face is substantially circular in shape and the cover is configured to cover about half of the cap face.

5. The bottle of claim 1, wherein the spout is flexible and is detachably attachable to the cap.

6. The bottle of claim 1, wherein the exposed length of the spout is greater than a diameter of the cap.

7. The bottle of claim 1, further comprising a diaphragm configured under the cover and cap and extending over the opening in the bottle; wherein the diaphragm has a cover shaft recess to receive a cover shaft coupled to the cover.

8. The bottle of claim 1, wherein the cover comprises a pinch feature comprising an extension from the inside perimeter wall and configured to align with the fold partition and pinch the flexible spout when the cover is in a closed position.

9. The bottle of claim 1, wherein the cover is detachably attachable to the cap.

10. The bottle of claim 9, wherein the cap comprises a cover aperture and wherein the cover comprises a cover shaft configured to extend through said cover aperture to detachably attach the cover to the cap.

11. The bottle of claim 10, wherein the shaft is a split barbed shaft whereby a barbed portion of the split barbed post is configured to extend through the cover aperture and be retained on an inside surface of the cap.

12. The bottle of claim 1, further comprising a ratchet feature, whereby the cover can completely rotate around a full rotation in only one direction.

13. The bottle of claim 12, wherein the ratchet feature comprises a guide post configured on the cover and a guide recess configured in the cap, whereby the guide post is configured to move within the guide recess when the cap is attached to the cover and rotated.

14. The bottle of claim 13, wherein the guide recess comprises at least one post stop, wherein the post stop prevents the cover from rotating in a direction.

15. The bottle of claim 1, further comprising a detachably attachable handle comprising:

a) a grip portion that extends over the first and second enclosures;

b) a first handle extension that extends down from the grip portion and down along a first side of the bottle;

c) a second handle extension that extends down from the grip portion and down along a second side of the bottle, wherein the second side is an opposing side from said first side;

d) an extension attachment feature configured on the first handle extension and on the second handle extension;

wherein the bottle comprises an extension/bottle attachment feature configured on a bottom of said bottle;

wherein the first and second extensions extend down around opposing sides of the bottle and under the bottom of the bottle where the extension attachment features detachably attach to the bottle/extension attachment feature on the bottom of the bottle.

16. A bottle comprising:

a) a first and a second enclosure, each comprising:

b) an opening;

c) a detachably attachable cap configured to be attached to said bottle over said opening comprising;

i) an inside surface;

ii) an outside surface;

iii) a perimeter;

iv) a cap face comprising:

a spout section;

a fold section; and a cover section;

v) a spout aperture located in the spout section that extends from an outside surface to the inside surface wherein said spout aperture is offset from a center of the cap face vi) a closure partition that extends up from said cap face and across said cap face from a first side to a second side and between said cover section, and said spout and said fold sections of the cap;

vii) a fold partition that extends up from said cap face and is configured between the spout section and fold section;

d) a cover configured to cover a portion of said cap and configured to rotate, clockwise or counter clockwise about a rotational axis, from a closed position to an open position and comprising:

a top portion that is offset from the cap face by a cover offset distance;

an inside perimeter wall that extends circumferentially around said top portion of the cover;

a pinch feature comprising an extension from the inside perimeter wall and configured to align with the fold partition and pinch the flexible spout when the cover is in a closed position;

e) a flexible spout coupled to said cap in said spout section and having an extended end, an exposed length from the spout aperture to the extended end, an overall length and length axis;

wherein said cover is configured to rotate from an open position, wherein the spout section is not covered, to a closed position, wherein said top portion of the cover is configured over the spout section;

whereby when said cover rotates from an open position to a closed position, the top portion of the cover intersects with said spout and folds said spout, at the spout aperture, to align said exposed length of the flexible spout to be parallel with and tangential to the outside surface of the cap face and wherein the extended end of the spout extends beyond an outer perimeter of the cap, wherein the spout is folded from a substantially perpendicular orientation to the cap face to a substantially parallel orientation to the cap face, and whereby further rotation of said cover creates a second fold in the spout that is located along an exposed length of the spout and about said fold partition, wherein in the closed position, the spout is retained under the top portion of the cover with the extended end of said spout in the fold section of said cap and wherein the spout extends from the spout aperture along the cap face and through a space between the fold partition and the inside perimeter wall of the cover such that a fold of the flexible spout about the fold partition is in a radial direction to a direction of rotation of the cover;

wherein in the closed position, the spout is folded in two separate locations, at the spout aperture and around the fold partition and wherein the spout is retained in a retained configuration under the cover with the length axis substantially parallel with the cap face and wherein the exposed length of the spout is aligned with the cap face.

17. The bottle of claim 16, further comprising a handle comprising:

a first handle extension comprising an extension attachment feature;

a second handle extension comprising an extension attachment feature; and a grip portion;

wherein the bottle comprises an extension bottle attachment feature configured on a bottom of said bottle;

wherein the grip portion is configured above the opening of the enclosure; and wherein the first and second extensions extend down around opposing sides of the first and second enclosures, and between the first and second enclosures where the extension attachment features detachably attach to the bottle extension attachment feature on the bottom of said bottle;

wherein at least one of said first enclosure and second enclosure are detachably attachable to said handle.

18. The bottle of claim 16, where the first enclosure and second enclosure are detachably attachable to each other.

19. The bottle of claim 16, further comprising a ratchet feature, whereby the cover can completely rotate around a full rotation in only one direction.

20. The bottle of claim 19, wherein the ratchet feature comprises a guide post configured on the cover and a guide recess configured in the cap, whereby the guide post is configured to move within the guide recess when the cap is attached to the cover and rotated and wherein the guide recess comprises at least one post stop, wherein the post stop prevents the cover from rotating in a direction.

* * * * *